US005308128A

United States Patent [19]

Portelli et al.

[11] Patent Number: 5,308,128

[45] Date of Patent: May 3, 1994

[54] VEHICLE DOOR LATCH

[75] Inventors: Alfred L. Portelli, Waterford; Rita M. Paulik, Sterling Heights, both of Mich.

[73] Assignee: General Motors Corporation, Detroit, Mich.

[21] Appl. No.: 12,858

[22] Filed: Feb. 3, 1993

[51] Int. Cl.[5] ..... E05C 3/16

[52] U.S. Cl. ..... 292/216; 292/DIG. 27; 292/DIG. 56

[58] Field of Search ..... 292/216, 280, DIG. 27, 292/DIG. 65, 201, DIG. 56

[56] References Cited

U.S. PATENT DOCUMENTS

| | | | |
|---|---|---|---|
| 2,777,719 | 1/1957 | Jeavons . | |
| 2,876,032 | 3/1959 | Pickles . | |
| 2,916,318 | 12/1959 | Voorhees . | |
| 3,049,372 | 8/1962 | Pickles | 292/216 |
| 3,563,589 | 8/1968 | Kwasiborski, Jr. | 292/216 |
| 3,583,742 | 6/1971 | Kwasiborski, Jr. | 292/216 |
| 3,923,329 | 12/1975 | Torii et al. | 292/216 |
| 4,334,704 | 6/1982 | Yamada | 292/216 |
| 4,487,441 | 12/1984 | Miyamoto et al. | 292/336.3 |
| 4,492,395 | 1/1985 | Yamada | 292/216 |
| 4,756,563 | 7/1988 | Garwood et al. | 292/216 |
| 4,900,074 | 2/1990 | Kleefeldt et al. | 292/DIG. 65 X |
| 4,969,673 | 11/1990 | Portelli et al. | 292/216 |
| 5,046,769 | 9/1991 | Rimbey et al. | 292/216 |
| 5,092,638 | 3/1992 | Miyuki | 292/DIG. 65 X |

*Primary Examiner*—Richard E. Moore
*Attorney, Agent, or Firm*—Charles F. Leahy

[57] ABSTRACT

A vehicle door latch has a selectively activated security lock that prevents a vehicle door from being unlatched by an inside door handle. The security lock is activated and deactivated when the vehicle door is open by inserting a key or other probe-like instrument into a slot in an inner panel of the vehicle door to manipulate a moveable arm of the security lock.

8 Claims, 6 Drawing Sheets

FIG-7
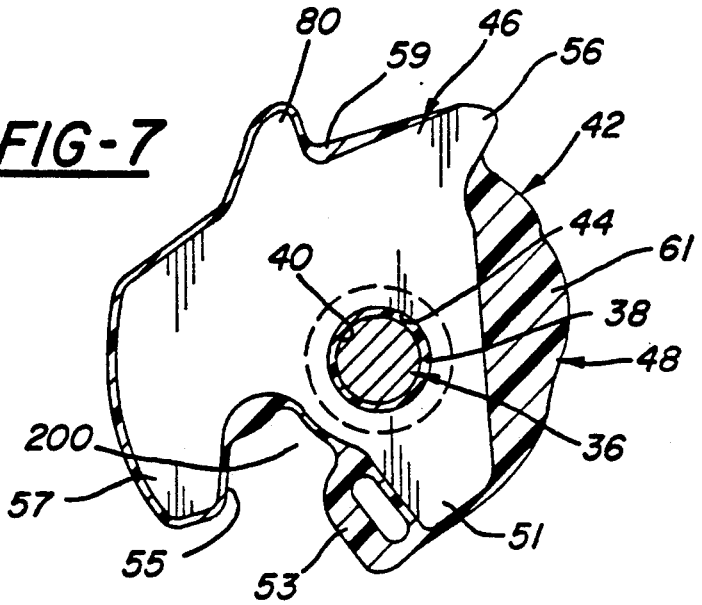
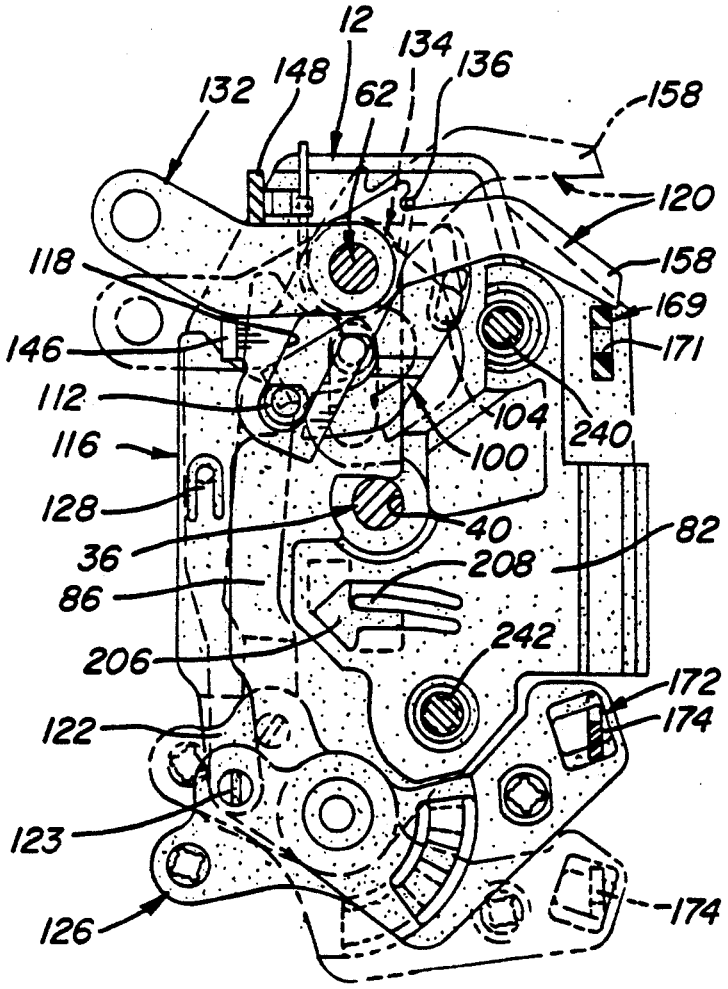
FIG-3

VEHICLE DOOR LATCH

BACKGROUND OF THE INVENTION

This invention relates to automotive vehicle door latches and more particularly to automotive vehicle door latches that have a selectively activated security lock that prevents the vehicle door from being unlatched by an inside door handle or other similar inside operator.

Automotive vehicle door latches are typically unlatched from inside the passenger compartment by an inside door handle or the like that is mechanically connected to the door latch by a linkage system that operates an unlatching lever in the door latch in response to operation of the inside door handle.

The vehicle door latches also typically include a lock mechanism that prevents the door from being unlatched by either the inside or an outside door handle.

Automotive vehicle door latches and door latch systems that have security locks are also known. When activated, the security lock prevents the door from being unlatched by the inside door handle even if the lock mechanism is not engaged. See for instance, U.S. Pat. No. 5,064,769 granted to Ronald P. Rimby and Rita M. Paulik Sep. 10, 1991 for a door latch coupling arrangement.

SUMMARY OF THE INVENTION

The object of this invention is to provide an automotive vehicle door latch that has a security lock that is compact, simple in construction and easy to install.

A feature of the automotive vehicle door latch of this invention is that the door latch has a security lock that has fewer parts and that is easier to install than the security lock known from the patent discussed above.

Another feature of the automotive vehicle door latch of this invention is that the door latch has a security lock that consists of only two parts so that the security lock is economical to manufacture.

Another feature of the automotive vehicle door latch of this invention is that the door latch has a security lock that is easy to install.

Still another feature of the automotive vehicle door latch of this invention is that the door latch has a security lock that can be installed simply by replacing a conventional inside operating lever without any need for structural modification of the door latch.

These and other features of the automotive vehicle door latch of this invention will be readily apparent to those skilled in the art as the nature of the invention is better understood from the accompanying drawings and detailed description.

BRIEF DESCRIPTION OF THE DRAWINGS

FIG. 3 is a rear view taken substantially along line 3—3 of FIG. 2. The latched and unlocked condition is shown in solid lines while various parts are also shown in unlatching or locked positions in phantom;

FIG. 7 is an enlarged front view of the insert molded door latch ratchet.

DESCRIPTION OF THE PREFERRED EMBODIMENT

Figure 1:
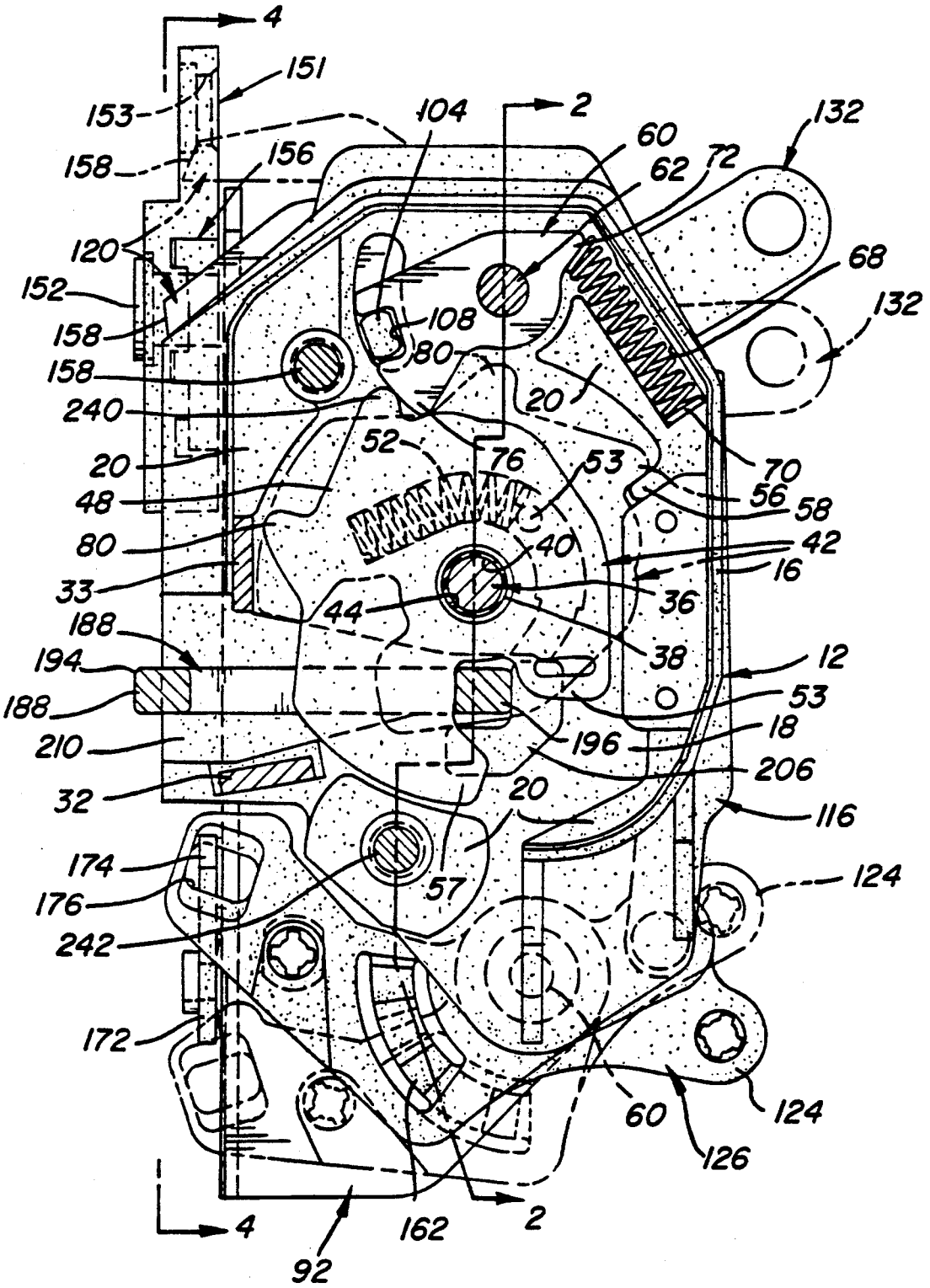
FIG. 1 is a partially broken away front view showing a vehicle door latch of the invention in a latched and unlocked condition in solid lines. Various parts are also shown in unlatching or locked positions in phantom.
Figure 2:
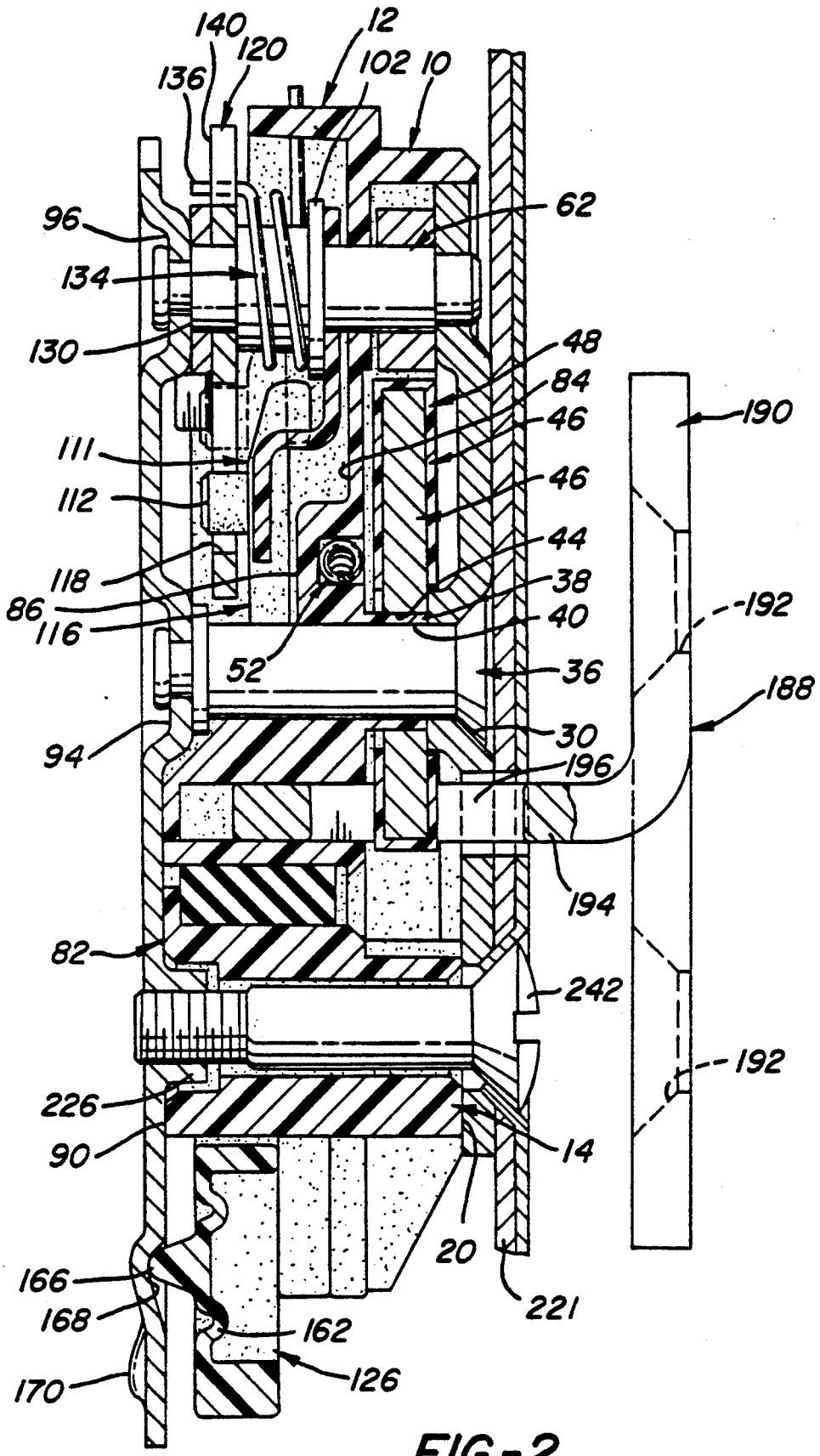
FIG. 2 is a sectional view taken substantially along 2—2 of FIG. 1. An intermittent lever is also shown in a locked position in phantom.
Figure 6:
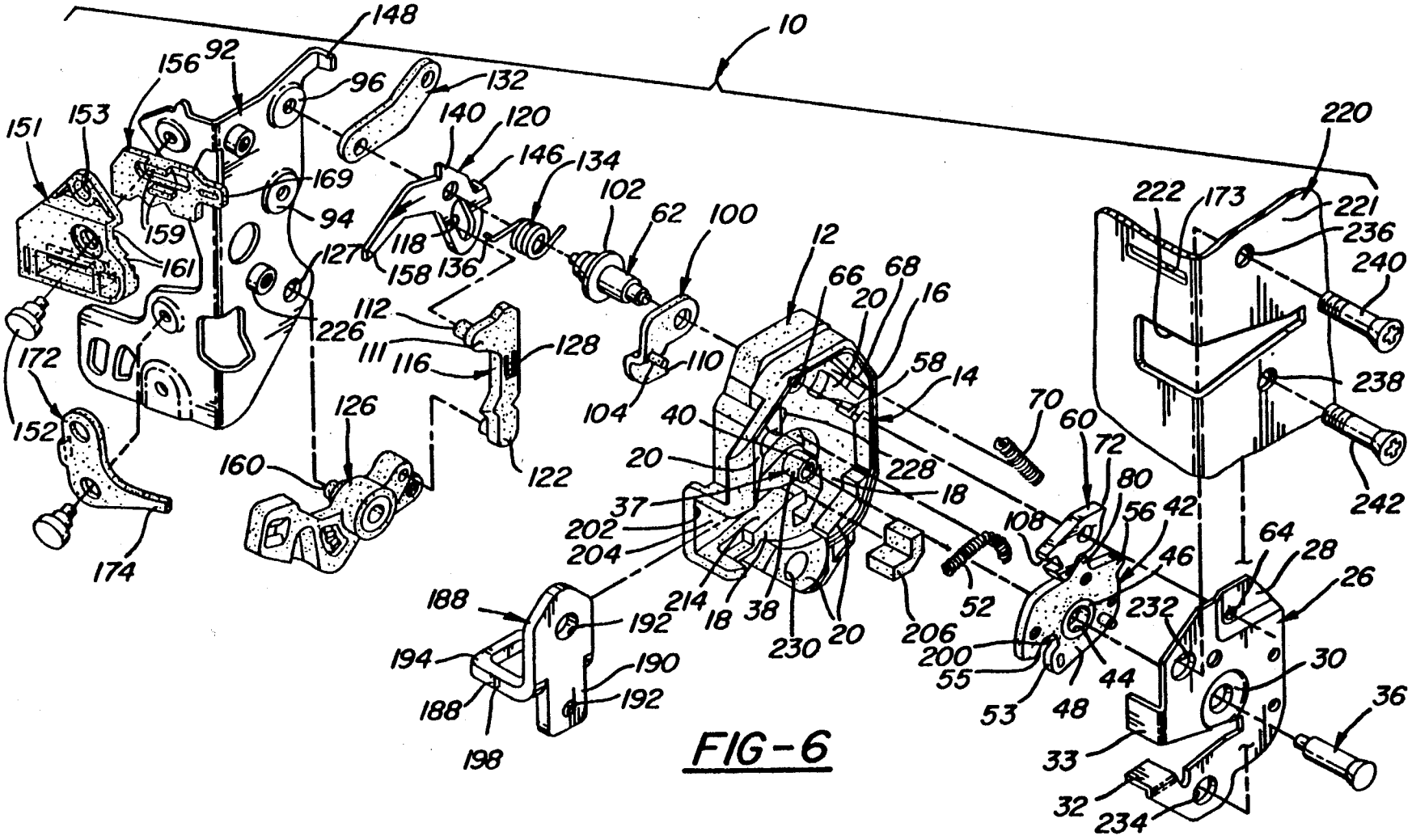
FIG. 6 is an exploded perspective view of the vehicle door latch and a fragment of the door on which it is installed.

Referring to FIGS. 1, 2 and 6, a vehicle door latch 10 includes a one-piece molded plastic housing member 12 which opens to a front side 14. The housing 12 includes relatively thin, broken peripheral wall 16, that outlines a cavity that has a recessed base wall 18. The housing 12 also has a number of coplanar shelf portions 20 inside the peripheral wall 16 that are only slightly recessed. A metal cover plate or frame member 26 fits within the wall portions 16, and seats on the shelf portions 20 to close the front side 14 of the housing 12. The frame 26 includes an inwardly recessed upper corner portion 28, an extruded central portion 30 and a pair of side tabs 32 and 33 as shown in FIG. 6.

A ratchet stud 36 is received by the extruded central portion 30 of the frame 26 which provides an increased support surface for the head end of the stud 36. A portion of the stud 36 is disposed in a thin plastic sleeve 37 that is integrally attached to the housing 12 and then in a hole 40 through the base wall 18 as shown in FIG. 2. The thin plastic sleeve facilitates assembly and then breaks away in service to provide a sleeve bearing 38 between the stud 36 and a rotatable door latch ratchet 42.

Referring now to FIGS. 1, 6 and 7, the ratchet 42 comprises a metal substrate 46 that has a hole 44 that receives the stud 36 and the sleeve bearing 38 so that the ratchet 42 rotates on the stud 36 without any metal-to-metal contact. The integral plastic sleeve 37 then has two primary functions, that of locating the ratchet 42 during assembly, and that of providing a sleeve bearing 38 that eliminates metal-to-metal contact between the ratchet 42 and the stud 36 when the ratchet 42 rotates in service.

The metal substrate 46 which is best shown in hidden line in FIG. 7, is injection molded in a covering 48 of relatively tough and stiff thermoplastic material such as Santoprene, a product of Monsanto Company of St. Louis, Mo. The plastic covering 48 does not cover the hole 44 or the faces of the substrate 46 near the hole 44 of the ratchet 42, as best seen in FIGS. 5, 6 and 7 to avoid interfering with rotation of the ratchet 42.

Figure 5:
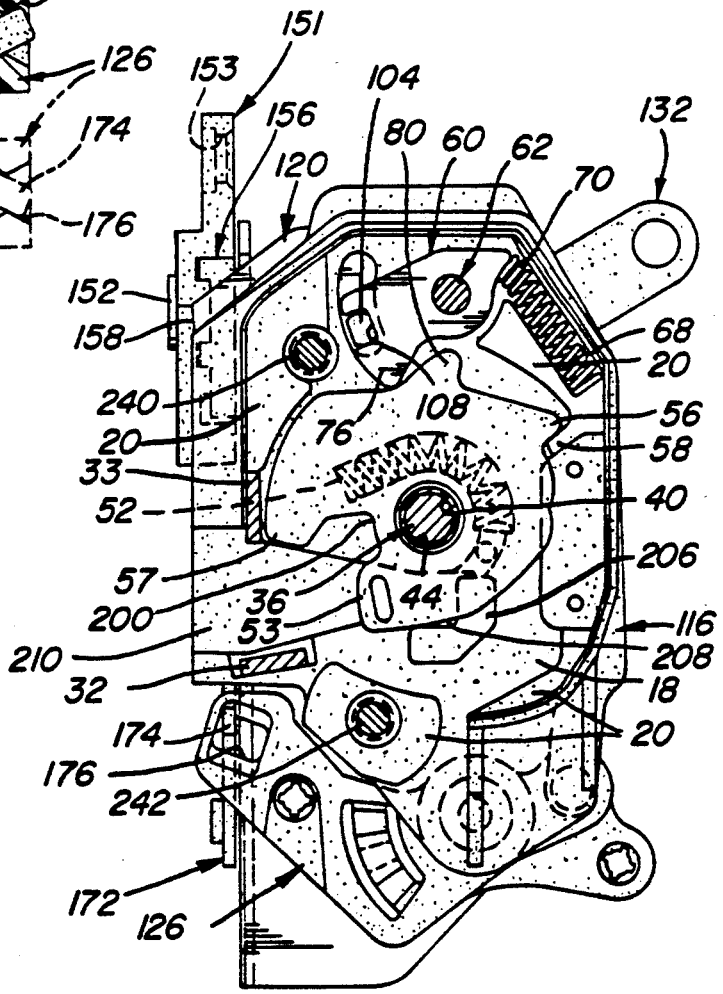
FIG. 5 is a view similar to FIG. 1 showing the vehicle door latch in an unlatched and unlocked condition.

The plastic covering 48 also does not cover the peripheral surface of a primary latching tooth 56 so that there is metal-to-metal contact between the primary latching tooth 56 and the pawl 60 when the ratchet 42 is in the latched position as shown in FIGS. 1 and 5. The plastic covering 48, however does has a substantial presence in other peripheral areas. The covering 48 includes a thick portion in front of a striker tooth 51 that is slotted to provide an integral bumper 53 for cushioning initial engagement of a striker when the vehicle door is closed as explained below. The plastic covering 48 also includes another cushion 55 covering a keeper portion 57 of the ratchet 42 that engages the striker when the ratchet is in the latched position as shown in FIGS. 1 and 5. The plastic covering 48 also includes yet another cushion 59 that covers the periphery of the substrate 46 between the keeper portion 57 and the peak of the primary latching tooth 56 for quiet operation as the pawl 60 ratchets over a secondary latching tooth 80 when the door is closed. The plastic covering 48 further includes a large chord shaped area 61 between the primary latching tooth 56 and the striker tooth 51 that reduces the size and weight of the metal substrate 46 and also provides a base for an integral pin 43.

Referring now to FIG. 2, a groove 50 in the recessed base wall 18 houses a coil compression spring 52. The pin 53, as seen in hidden line in FIG. 1, molded integral with the sound deadening plastic covering 48 of the ratchet 42, engages one end of the coil compression spring 52. The other end of the spring 52 engages an end wall of the groove 50, so that the spring 52 biases the ratchet 42 clockwise from a latched position shown in solid line in FIG. 1 through an intermediate latched position (not shown) to an unlatched position shown in phantom in FIG. 1 and in solid line in FIG. 5 when pawl 60 is disengaged. The primary latching tooth 56 engages a shoulder 58 of the housing 12 to stop the ratchet 42 in the unlatched position.

Referring now to FIGS. 2 and 6, a pawl 60 is pivotally mounted on a pawl stud 62 for movement between an engaged position shown in solid line in FIG. 5 and an unlatching position shown in phantom in FIG. 5. A groove 68 in one of shelf portions 20 of the housing 12 houses a second coil compression spring 70. A shoulder 72 of the pawl 60 engages one end of the coil compression spring 70. The other end of the spring 70 engages an end wall of the groove 68 biasing the pawl 60 counterclockwise, as viewed in FIGS. 1 and 5, toward the engaged position. The pawl 60 has a pawl tooth 76 which engages the primary latching tooth 56 of the ratchet 42 as shown in FIG. 1 to latch the ratchet 42 in the fully latched position. Although not shown in the drawings, the pawl tooth 76 is also engageable with the secondary latching tooth 80 of the ratchet 42 to locate the ratchet 42 in an intermediate latched position where the ratchet 42 retains the striker 188 loosely.

Referring to FIGS. 2 and 3, the housing 12 has a back side 82 with a series of rear base wall portions 84, 86, and 90, which are parallel. A metal back plate 92 engages the outer rear base wall portion 90 and includes a plurality of recessed portions 94 and 96 as shown in FIG. 6.

Referring to FIGS. 2 and 6, a non-metallic or plastic pawl release lever 100 is coaxially pivoted with the pawl lever 60 on the pawl stud 62 and between the rear base wall portion 84 and a rib 102 of the pawl stud 62. Referring to FIG. 1, the pawl release lever 100 has a lateral tab 104 which extends through a slot 106 in the housing 12 and is received by a notch 108 of the pawl 60 to couple the pawl release lever 100 to the pawl 60. Referring to FIGS. 3 and 6, an offset foot 110 of the pawl release lever 100 is engageable by an integral ear 111 of a non-metallic or plastic molded intermittent lever 116.

Referring to FIGS. 2 and 3, the integral ear 111 of the intermittent lever 116 has a pin 112 that is slideably captured in a linear tracking slot 118 of an unlatching lever 120. A lower end 122 of the intermittent lever 116 is pivotably mounted to a first end 124 of a locking lever 126 by a bifurcated protrusion 123 of the intermittent lever 116 that is biasingly engaged in a hole in the locking lever 126 to provide for quiet anti-rattle rotation. As shown in FIGS. 3 and 6, the intermittent lever 116 is interposed between the locking lever 126 and unlatching lever 120 on one side, and the rear base wall portion 86 of the housing 12 on the other. An integrally molded finger 128 of the intermittent lever 116 engages the rear base wall portion 86 to snugly bias the intermittent lever 116 against the locking lever 126 and the unlatching lever 120 to prevent rattling. The intermittent lever 116 moves with the locking lever 126 between an unlocked position shown in solid line in FIGS. 2 and 3 and a locked position shown in phantom.

The rotation of the pawl release lever 100 is dependent on the position of the intermittent lever 116, which is part of the locking mechanism, and the rotation of the unlatching lever 120, which is part of the unlatching mechanism. The unlatching mechanism will be discussed more fully before the discussion of the locking mechanism.

Referring to FIGS. 2 and 6, the unlatching lever 120, whose slot 118 receives the integral pin 112 of the intermittent lever 116, is pivotably mounted on the panel stud 62 between a shoulder 130 of the panel stud 62 and a non-metallic plastic molded outside operating lever 132. A coil torsion spring 134 encircles the panel stud 62 between the rib 102 and the shoulder 130, and it has a leg 136 which engages an upper edge 140 of the unlatching lever 120, as seen in FIG. 3. The other end of the coil torsion spring 134 engages a ramp on the housing 12 so that the torsion spring 134 biases the unlatching lever 120 clockwise to a rest position seen in FIG. 3. It should be noted that FIGS. 1, 5 and 6 are front views while FIG. 3 is a rear view. Consequently spring 134 biases unlatching lever 120 counter-clockwise in FIGS. 1, 5 and 6.

Referring to FIGS. 3 and 6, the outside operating lever 132, pivotably mounted on the pawl stud 62 and interposed between the back plate member 92 and the unlatching lever 120, seats on a lateral tab 146 of the unlatching lever 120. Referring to FIG. 3, an outside door handle (not shown) rotates the outside operating lever 132 counterclockwise to unlatch the door latch 10. The outside operating lever 132 rotates the unlatching lever 120 counterclockwise simultaneously from their rest positions to their respective unlatching position, shown in phantom in FIG. 3. When released the outside operating lever 132 is returned to its rest position by the lateral tab 146 of the unlatching lever 120 transferring the bias of the torsion spring 134. A lateral tab 148, best seen in FIGS. 3 and 6, of the back plate 92 limits the clockwise motion of the outside operating lever 132 and the unlatching lever 120.

Referring to FIGS. 3, 4 6, 8 and 9, a nonmetallic plastic molded inside operating lever 150 is also capable of rotating the unlatching lever 120 to an unlatching position against the bias of torsion spring 134. The inside operating lever 150 is pivoted to a side flange 154 of the back plate 92 and it has a retractable arm 156 underlying a leg 158 of the unlatching lever 120. The inside operating lever 150 is connected to and rotated by an inside operating handle, not shown. When lever 150 is rotated clockwise as viewed in FIGS. 4 and 6, it rotates the unlatching lever 120 counter clockwise as viewed in FIG. 3 (clockwise as viewed in FIG. 6).

The vehicle door latch 10 has a security lock that prevents the inside operating handle from rotating the unlatching lever 120 so as to unlatch the door latch 10. The security lock includes the inside operating lever 150 in place of the inside operative lever of one piece construction that is shown in pending patent application Ser. No. 07/996,816 filed Dec. 24, 1992, that is assigned to the assignee of this invention.

The inside operating lever 150 is rotatably mounted on the back plate 92 for rotation from a rest position to an unlatch position where the inside operating lever 150 has a potential for positioning the unlatching lever 120 in its unlatch position. The inside operating lever 150 consists essentially of two moldable plastic parts—the arm 156 and a rotor 151 for rotating the arm 156 back and forth in an arc.

Figure 8:
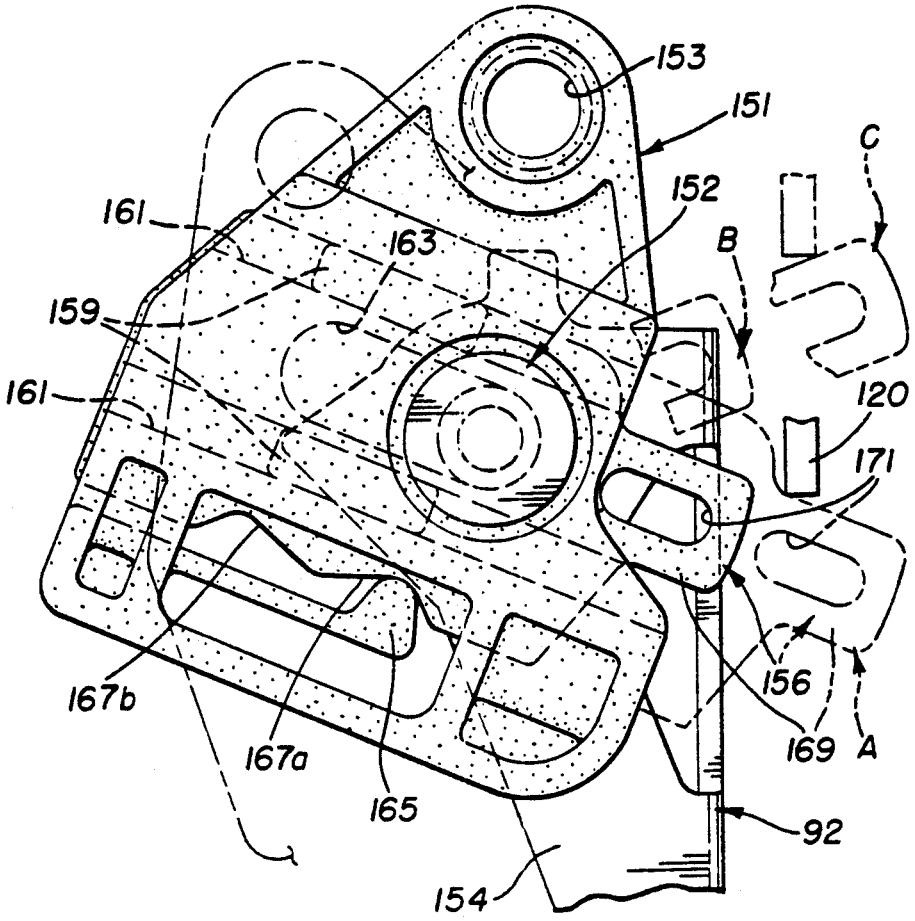
FIG. 8 is an enlargement of a portion of FIG. 4.

The rotor 151 is rotatably mounted on the side flange 154 of the back plate 92 by a headed stud 152 and it includes an aperture 153 for connecting the rotor 151 to the inside operating handle by suitable linkage so that the rotor 151 is rotated by the inside operating handle from its rest position shown in FIG. 8 in solid line to its unlatch position shown in phantom.

The arm 156 is slideably mounted on the rotor 151 so that it has a retracted position and an extended position respectively shown in solid line and in phantom at A in FIG. 8. When the arm 156 is retracted as shown in solid line in FIG. 8, the arm 156 bypasses the unlatching lever 120 when the rotor 151 is rotated by the inside operating handle from its rest position to its unlatch position shown at B in FIG. 8. However, when the arm 156 is extended as shown in phantom in FIG. 8, the arm 156 engages and moves the unlatching lever 120 to its unlatching position when the rotor 151 is rotated from its rest position shown at A to its unlatch position shown at C in FIG. 8.

Figure 9:
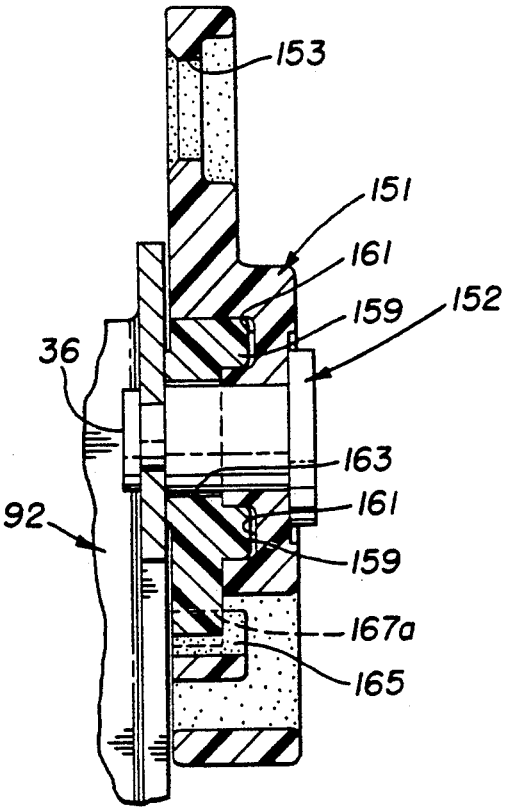
FIG. 9 is a section taken substantially along the line 9—9 of FIG. 8 looking in the direction of the arrows.

The arm 156 is disposed between the rotor 151 and the flange 154 of the back plate 92 as shown in FIG. 9 and fastened in place by the headed stud 152 that attaches rotor 151. The arm 157 has two projections 159 that slide in two tracks 161 of the rotor 151. The arm 157 also has a slot 163 that is parallel to the projections 159 and tracks 161. The stud 152 passes through the slot 163 so that the arm 156 can slide in the tracks 151 relative to the rotor 151 and to the back plate 92.

The arm 156 and the rotor 151 include a detent for holding the arm 156 in the retracted or bypass position shown in solid line in FIG. 8 or in the extended or engage position that is shown in phantom at A and C. This detent comprises an integral spring finger 165 of the rotor 151 that engages notches 167*a* and 167*b* in the side of the arm 156. The spring finger 165 engages either notch 167*a* to hold the arm 156 in the retracted or bypass position shown in solid line in FIG. 8 or notch 167*b* to hold the arm 156 in the extended or engage position shown in phantom at A and C.

The arm 156 has an end 169 that engages the unlatching lever 120 when the arm 156 is in the extended position shown in phantom at A and C in FIG. 8. This end has a slot 171 for manipulating the arm 156 and moving it back and forth between the retracted and extended positions. The rotor 151 does not cover the end 169 of the arm 156, even when the arm 156 is in the retracted position so that the end 169 and the slot 171 are exposed and accessible for manipulating the arm 156. The slot 171 is reached by means of a key or other small probe like instrument via an access slot 173 in an inner panel of the vehicle door as shown in FIG. 6.

The key or its equivalent is inserted into the slot 171 via the access slot 173 to retract the arm 156 and activate the security lock or extend the arm 156 to deactivate the feature. The access slot 173 is located in a portion of the door panel that is covered by the door jamb when the vehicle door is closed so that the security lock cannot be deactivated from inside the vehicle.

Now that the operating levers of the unlocking mechanism including the security lock have been described fully, the description of the locking mechanism will be completed. Referring to FIGS. 1 and 2, the locking lever 126 is pivotably mounted at 160 between a portion of the housing 12 and the back plate 92 by an integral protrusion of the housing 12 that fits in a pivot hole in the locking lever 126 and a stud of the locking lever 126 that fits in a pivot hole 127 in the back plate 92. The locking lever 126 includes an integral deflectable web 162 having a shoulder 166 biased into engagement with either a first recess 168 or a second recess 170 of the back plate 92 is shown in FIG. 2 to locate the locking lever 126 in either the unlocked position shown in solid line in FIG. 1 or in the locked position shown in phantom. The deflectable web 162 also provides tactile feel of the locking mechanism establishing positive position of the locking lever 126 in either the locked or unlocked position. The web 162 is made deflectable by spaced U-shaped portions connecting the shoulder 166 to the main part of the locking lever 126, as shown in FIG. 2.

The first end 124 of the locking lever 126 has an opening which is connected to an outside key cylinder by rod, or other suitable means, to move the locking lever 126 between the locked and unlocked positions.

Figure 4:
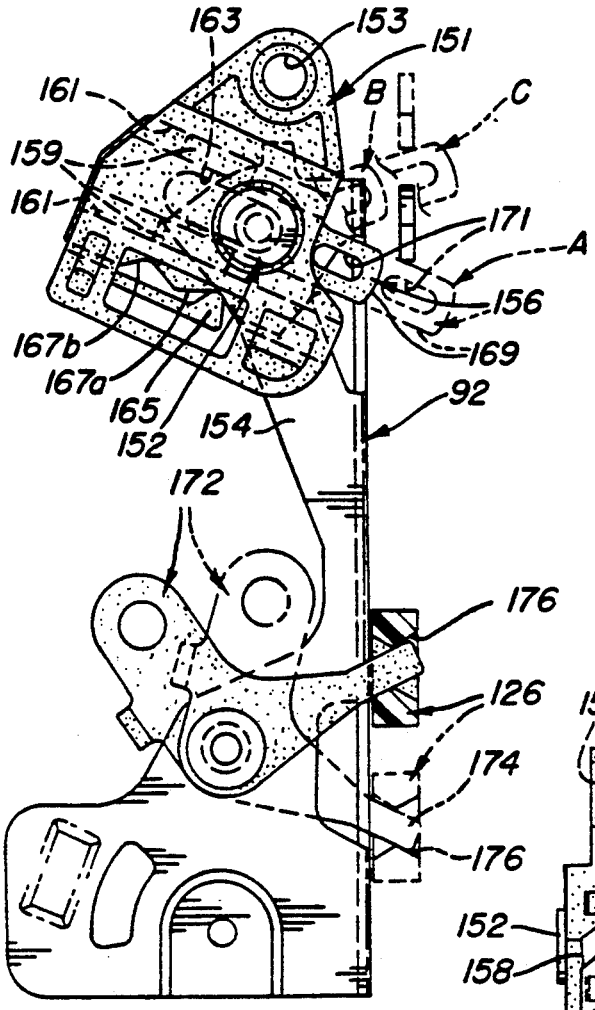
FIG. 4 is a partial sectional view taken substantially along line 4—4 of FIG. 1 with various parts also shown in phantom in unlatching or locked positions.

Referring to FIGS. 1 and 4, a non-metallic, plastic molded inside locking lever 172 is pivotably mounted to the side flange 154 of the back plate member 92 at pivot point 173. The inside locking lever 172 is conventionally connected to an inside lock operator such as a linearly shiftable slide button. The inside locking lever 172 includes a leg 174 which is received within a tapered opening 176 at a second end 178 of the locking lever 126 such that movement of the inside locking lever 172 moves the locking lever 126 between its corresponding locked and unlocked positions. The inside locking lever 172 is identical to the inside operating lever 132 to reduce manufacturing cost.

With the unlatching mechanism and the locking mechanism described, the interaction between the two will be described. Referring to FIGS. 2 and 3, when the locking lever 126 and the intermittent lever 116 are in the unlocked position, thereby the integral pin 112 of the intermittent lever 116 is at a lower end 180 of the linear tracking slot 118 in the unlatching lever 120 in alignment for engagement with the foot 110 of the panel lever 100. Consequently, when the unlatching lever 120 is rotated counterclockwise by either the outside operating lever 132 or the inside operating lever 150 from the rest position to the unlatching position shown in phantom in FIG. 3, the integral pin 112 of the intermittent lever 116 engages the foot 110 of the panel release lever 100 rotating the panel release lever 100 and simultaneously rotate the panel 60 to the unlatching position shown in phantom in FIG. 1. This disengages the panel tooth 76 from the primary latching tooth 56 of the ratchet 42 which is then rotated clockwise by the spring 52 and/or the striker during door opening to the unlatched position shown in FIG. 5. Spring 70 returns the pawl 60 to the latched position when the unlatching lever 120 is released. During this unlatching movement, the intermittent lever 116 rotates about the bifurcated protrusion 123 which pivotally connects the lower end 122 to the locking lever 126.

When the locking lever and the intermittent lever 116 are in the locked position as shown in phantom in FIGS. 1 and 2 the integral pin 112 of the intermittent lever 116 is at an upper end 182 of the linear tracking slot 118 in the unlatching lever 120. Consequently when the unlatching lever 120 is rotated counterclockwise by either the outside operating lever 132 or the inside operating lever 150, the integral ear 111 of the intermittent lever 116 misses the foot 110 moving into a slot 184 of the pawl release lever 100 so that pawl release lever 100 and the pawl lever 60 are not rotated to the unlatching position and the pawl tooth 76 remains engaged with the primary latching tooth 56 of ratchet 42.

With the operating levers or unlatching mechanism and locking mechanism and their interaction described, the interaction of the door latch 10 with a striker 188 will be described. Referring to FIGS. 2 and 6, the striker 188 is formed out of a one-piece stamping which includes a mounting plate portion 190 having a pair of holes 192 for mounting to a vehicle body structure such as a vehicle pillar. Referring to FIG. 1, a loop striker portion 194 of rectangular cross section of the striker 188 includes an outboard leg 198 and an inboard leg 196. The outboard leg 198 is received in a throat 200 of the ratchet 42 of the door latch 10 when the door latch 10 is in the latched position.

Referring to FIGS. 1 and 6, the housing 12 of the door latch 10 has a deep recess 202 that extends inwardly from the base wall 18 to a back wall 204. The inner end of the recess 202 hooks back to form a spring arm 208 in cooperation with a slot through the back wall 204 as best shown in FIG. 3. A symmetrical elastomer bumper 206 is laterally inserted into the inner end of the recess 202 with the lower portion of the symmetrical elastomer bumper 206 being snapped past and held in place by the spring arm 208. The recess 202 defines a throat 210 within the plastic housing 12 to receive the striker 188. The frame 26 includes a "fishmouth" slot 212 that aligns with the throat 210 of the housing 12 when the frame 26 is attached. The side tabs 32 and 33 of the frame 26 project into slots of the housing 12 that communicate with the throat 210 as shown in FIGS. 1, 5 and 6. These tabs retain the ratchet 42 inside the plastic housing 12 in the event that the ratchet stud 36 and the plastic housing 12 itself do not do so.

Referring to FIG. 2, the door latch 10 is held together as an assembled door latch by the ratchet stud 36 and the pawl stud 62 which have their ends peened at the recessed portions 94 and 96 of the back plate 92 respectively. The ratchet stud 36 holds the plastic housing 12 metal frame 26 and back plate 92 together and also pivotally retains the ratchet 42 between the base wall 18 of the housing 12 and the metal frame 26. The pawl stud 62 peened at both ends helps align members 26, 12, and 92 and pivotally locates the pawl 60, the pawl release lever 100, the unlatching lever 120, and the outside operating lever 132 and carries the coil torsion spring 134. As stated above, the locking lever 126 is pivotably mounted at 160 and disposed between the housing 12 and the back plate 92. The inside operating lever 150 and the inside locking lever 172 are pivotally mounted on the side flange 154 of the back plate 92.

Referring to FIGS. 2 and 6, the assembled door latch 10 is installed in a vehicle door 220 with the frame 26 abutting an interior surface of a free end wall 221 of a swinging door 220. The recessed corner portion 28 and the extruded central portion 30 of the metal frame 26 accommodate the head of the ratchet 30 and the peened head of the pawl 62 respectively. The end wall 221 and inner panel 223 of the door 220 have communicating slots that define an opening 222 that aligns with the throat 210 of the plastic housing 12 and the fishmouth slot 212 of the frame 26.

The door latch 10 is attached to the door 220 by a pair of bolts 240 and 242 that are inserted into openings 236 and 238 in the end wall 221 through holes 232 and 234 in the frame 26 and holes 228 and 230 in the housing 12 and then screwed into threaded apertures 224 and 226 in the back plate 92. The bolts 240 and 242 also provide additional fasteners that hold the parts of the door latch 10 together when the door latch 10 is installed snug against the end wall 221.

Bolt 240 extends through the door latch 10 in proximity to where the pawl tooth 76 of the pawl 60 engages one of the teeth 56 and 80 of ratchet 42 and sandwiches the engaged teeth between the housing 12 and the frame 26 so that the engaged teeth remain coplanar and do not bypass each other. In addition, the bolt 240, the ratchet stud 36 and the panel stud 62 define an imaginary triangle that contains the engaged teeth of the ratchet 42 and pawl 60 between the housing 21 and the frame 36 providing further assurance that the engaged teeth do not bypass each other.

Bolt 242 extends through the door latch 10 in proximity to where the ratchet 42 engages the striker 188 when the ratchet 42 is in the latched position shown in FIG. 1. The ratchet stud 36 is about the same distance away on the opposite side of the throat 210 and the latched striker leg 196. The bolt 242 and the ratchet stud 36 both retain the door latch 10 together and sandwich the ratchet 42 between the housing 12 and the frame 26 so that the ratchet 42 is held against lateral movement on both sides of the throat 210 near the engaged leg 196 of the striker 188. Consequently there is a very strong latching engagement of the striker 188.

The side tab 32 of the frame 26 protects the plastic housing 12 if the striker 188 is misaligned relative to the door latch 10 and initially engages the throat 210 lower than desired. Moreover, as indicated earlier the side tabs 32 and 33 which are on opposite sites of the throat 210 are also positioned inboard of the ratchet 42 so that it cannot be pulled out of the plastic housing by the striker 188 as shown in FIG. 1 thereby enhancing the overall strength of the door latch 10 under failure producing loads. It should b noted the throat 210 of the plastic housing 12 and the fishmouth slot 212 of the cover plate 26 are relatively narrow when the vehicle door latch 10 is designed for use with the striker 188 which is characterized by a loop portion of rectangular cross section. This relatively narrow fishmouth slot further enhances the overall strength of the door latch 10 because the minimum thickness of the metal plate 26 between the hole in the central portion 30 and the fishmouth slot 212 is increased in comparison to designs that are used with striker loop portions of circular cross section and that have the same operating effort.

The striker is the subject of a pending patent application, Ser. No. 971,159 filed Nov. 5, 1992 and assigned to the assignee of this invention.

Referring to FIGS. 1 and 5, as the door 220 is being closed, the outboard leg 196 of the striker 188 enters the throat 210 and engages the bumper 53 of the ratchet 42 and rotates the ratchet 42 counterclockwise from its unlatched position shown in FIG. 5, to its latched position shown in FIG. 1. The striker 188 is stopped in the latched position by the elastomer bumper 206. During this latching movement, the pawl tooth 76 first ratchets over the secondary latching tooth 80 and then the primary latching tooth 56 of the ratchet 42 until it engages the back side of the primary latching tooth 56 under the bias of compression spring 70.

This operation is quiet due to the sound deadening covering 48 of the ratchet 42 which is best shown in FIG. 7. First the striker engages the slotted bumper 53 which isolates the metal substrate 46 and deflects because of the slot to absorb the energy and sound of the striker 188 engaging the ratchet 42. Secondly the peripheral portion 59 of the covering 48 absorbs most of the energy and sound of the pawl 60 as the pawl tooth 76 ratchets on the ratchet 42 into position behind the primary latching tooth 56. Thirdly the latched leg 196 is stopped by the elastomer bumper 206 and held by the cushion 55 of the keeper portion 57 of the ratchet 42. This absorbs the energy and sound of the striker when the door is closed.

Referring to FIG. 2, the initial engagement and rotation of the ratchet 42 by the striker 188 creates a load on the thin plastic sleeve 37 that is generally uniform across the thickness of the ratchet 42. The thin plastic sleeve 37 that is integrally attached to the base wall 18 of the housing 12 in service without a radius which creates a stress riser at the corner of the sleeve and the base wall. The combination of the striker load and the stress riser causes the corner to fracture so that the thin plastic sleeve 37 breaks away from the base wall 18 of the housing 12 in service to provide a plastic sleeve bearing 38 between the metal ratchet stud 36 and the metal bore of the ratchet 42 that functions as a silencer.

Unlatching the door lock 10 to open the door is accomplished by releasing the striker 188 from the throat 200 of the ratchet 42 by disengaging the pawl tooth 76 from the primary latching tooth 56 so that the coil compression spring 52 returns the ratchet 42 to the unlatched position as described earlier.

The extensive use of non-metallic or plastic parts, except for the ratchet 42, the pawl 60 and the associated studs and springs which are required to hold the door latch 10 in the latched position, the plastic covering of the ratchet 42 and the break-away sleeve bearing 38 reduces the metal-on-metal contact to a minimum thereby creating a door latch that is very quiet in operation and that requires little if any lubrication. Furthermore, the integral finger 128 of the intermittent lever 116 and the internal web 162 of the locking lever 126 reduce vibration of these parts and the associated noise to enhance quiet operation.

The latch shown in the Figures is a right-hand door latch used on the passenger side of a vehicle. A left-hand door latch for the driver side of the vehicle work the same, but the latches are mirrored images of each other. Consequently, some parts of the latch are designed so that they can be used for either a right-hand or left-hand door latch to reduce manufacturing cost. For example, the pawl 60 and outside operating lever 132 are non-handed and can be used on either a right-hand or a left-hand door latch by flipping the part over. The metal substrate of the ratchet 42 is also non-handed and capable of being used in either latch, prior to being insert molded, where the pin 53 is added to one side of the cover. The right angled elastomer bumper 206 is symmetrical about multiple planes so that the bumper 206 can be used one-way for a right hand latch or rotated 90° for a left hand latch. In addition, the inside operating lever 150 and inside locking lever 172 are also identical to further reduce manufacturing costs.

The invention has been described in an illustrative manner, and it is to be understood that the terminology which has been used is intended to be in the nature of words of description rather than of limitation.

Obviously, many modifications and variations of the present invention in light of the above teachings may be made. it is, therefore, to be understood that, within the scope of the appended claims, the invention may be practiced otherwise than as specifically described.

The embodiments of the invention in which an exclusive property or privilege is claimed are defined as follows:

1. An automotive vehicle door latch having a security lock comprising;

a frame rotatably mounting an unlatching lever for rotation from a rest position to an unlatch position where the unlatching lever has a potential for unlatching the door latch, and an inside operating lever rotatably mounted on the frame for rotation from a rest position to an unlatch position where the unlatching lever has a potential for positioning the unlatching lever in its unlatch position, the inside operating lever consisting essentially of a rotor that is rotatably mounted on the frame and an arm disposed between the rotor and the frame and is slideably mounted in tracks provided on the rotor so that is has a bypass position where it bypasses the unlatching lever when the inside operating lever is rotated from its rest position to its unlatch position and so that it has an engage position where it positions the unlatching lever in its unlatch position when the inside operating lever is rotated from its rest position to its unlatch position.

2. An automotive vehicle door latch having a security lock comprising;

a frame rotatably mounting an unlatching lever for rotation about a first axis from a rest position to an unlatch position where the unlatching lever has a potential for unlatching the door latch, and an inside operating lever rotatably mounted on a flange of the frame for rotation about a second axis that is perpendicular to a plane containing the first axis from a rest position to an unlatch position where the unlatching lever has a potential for positioning the unlatching lever in its unlatch position, the inside operating lever consisting essentially of a rotor that is rotatably mounted on the frame and an arm that is slideably mounted on the rotor so that is has a retracted position where it bypasses the unlatching lever when the inside operating lever is rotated from its rest position to its unlatch position and so that it has an extended position where it positions the unlatching lever in its unlatch position when the inside operating lever is rotated from its rest position to its unlatch position.

3. The automotive vehicle door latch as defined in claim 2 wherein the arm is disposed between the rotor and the frame and slides in tracks in the rotor.

4. The automotive vehicle door latch as defined in claim 2 wherein the arm and the rotor include a detent for holding the arm in the retracted position or in the extended position.

5. The automotive vehicle door latch as defined in claim 2 wherein the arm has an exposed end when the arm is in the retracted position that has a slot that is adapted to receive an instrument for moving the arm from the retracted position to the extended position and vice-versa.

6. The automotive vehicle door latch as defined in claim 3 wherein the rotor has a spring finger that engages a first notch in the arm for holding the arm in the retracted position or a second notch in the arm for holding the arm in the extended position.

7. The automotive vehicle door latch as defined in claim 3 wherein the arm has an exposed end when the arm is in the retracted position that has a slot that is adapted to receive an instrument for moving the arm from the retracted position to the extended position and vice-versa.

8. The automotive vehicle door latch as defined in claim 6 wherein the arm has an exposed end when the arm is in the retracted position that has a slot that is adapted to receive an instrument for moving the arm from the retracted position to the extended position and vice-versa.

* * * * *